US009109179B2

(12) United States Patent
Cowin et al.

(10) Patent No.: US 9,109,179 B2
(45) Date of Patent: Aug. 18, 2015

(54) RENEWABLE BIOFUEL

(71) Applicant: Broadleaf Energy, LLC, Glenwood, MD (US)

(72) Inventors: Keith E. Cowin, Glenwood, MD (US); Robert H. Bullard, Glenwood, MD (US); Howard W. Bowman, III, Georgetown, DE (US)

(73) Assignee: Broadleaf Energy, LLC, Glenwood, MD (US)

( * ) Notice: Subject to any disclaimer, the term of this patent is extended or adjusted under 35 U.S.C. 154(b) by 0 days.

(21) Appl. No.: 13/829,278

(22) Filed: Mar. 14, 2013

(65) Prior Publication Data

US 2013/0276359 A1 Oct. 24, 2013

Related U.S. Application Data

(60) Provisional application No. 61/636,017, filed on Apr. 20, 2012.

(51) Int. Cl.

| | |
|---|---|
| ***C10L 1/32*** | (2006.01) |
| ***C10L 1/10*** | (2006.01) |
| ***C10L 1/18*** | (2006.01) |

(52) U.S. Cl.

CPC ..... *C10L 1/328* (2013.01); *C10L 1/1802* (2013.01); *C10L 2200/0295* (2013.01); *C10L 2200/043* (2013.01); *C10L 2200/0438* (2013.01); *C10L 2200/0484* (2013.01); *C10L 2290/24* (2013.01)

(58) Field of Classification Search

CPC ..... Y02E 10/00
USPC ..... 44/300–302, 385
See application file for complete search history.

(56) References Cited

U.S. PATENT DOCUMENTS

| | | | | |
|---|---|---|---|---|
| 5,344,306 | A * | 9/1994 | Brown et al. | 431/4 |
| 6,068,670 | A * | 5/2000 | Haupais et al. | 44/301 |
| 6,368,366 | B1 | 4/2002 | Langer et al. | |
| 6,368,367 | B1 | 4/2002 | Langer et al. | |
| 6,648,929 | B1 | 11/2003 | Daly et al. | |
| 6,946,008 | B2 * | 9/2005 | Wenzel | 44/302 |
| 7,906,082 | B2 | 3/2011 | Pelly | |
| 2005/0061262 | A1 | 3/2005 | Wong | |
| 2005/0217613 | A1 * | 10/2005 | Ambrosini et al. | 123/25 A |
| 2006/0048443 | A1 | 3/2006 | Filippini et al. | |
| 2006/0075680 | A1 | 4/2006 | Tort et al. | |
| 2010/0037513 | A1 | 2/2010 | Petrucci et al. | |

FOREIGN PATENT DOCUMENTS

| | | | |
|---|---|---|---|
| WO | WO-9818884 | A2 | 5/1998 |
| WO | WO 2007127059 | A2 * | 11/2007 |
| WO | WO-2008110688 | A2 | 9/2008 |
| WO | WO-2011130299 | A2 | 10/2011 |
| WO | WO-2012006316 | A1 | 1/2012 |

* cited by examiner

*Primary Examiner* — Pamela H Weiss
(74) *Attorney, Agent, or Firm* — Blank Rome LLP

(57) ABSTRACT

The present invention provides a stable fuel composition that can be used as a drop-in replacement for number 2 fuel oil without requiring infrastructure changes. The fuel comprises a continuous phase of mostly biofuel, an aqueous disperse phase, and at least one emulsifier. The continuous phase contains about 50 wt % to about 95 wt % of at least one liquid vegetable or liquid animal oil/fat or mixtures thereof; about 1 wt % to about 20 wt % of a renewable or fossil fuel derived thinning solvent or mixtures thereof, with or without 1 wt % to about 25 wt % of a C1-C4 monohydric alcohols, and with or without about 1 wt % to about 30 wt % of petroleum middle distillate. The aqueous phase contains about 1 wt % to about 50 wt % of deionized/purified water, with or without 1 wt % to about 25 wt % of a C1-C4 monohydric alcohols.

26 Claims, No Drawings

RENEWABLE BIOFUEL

The present invention claims the priority of U.S. Provisional Patent Application No. 61/636,017, filed Apr. 20, 2012, which is incorporated herein by reference.

FIELD OF THE INVENTION

The present invention relates to renewable fuel compositions and methods for making thereof. The fuel composition is based on liquid oil of vegetable or of animal origin.

BACKGROUND OF THE INVENTION

Number 2 fuel oil is a fraction obtained from petroleum distillation, that is used as heating oil. Number 2 fuel oil can be used interchangeably with diesel fuel. Indeed, both diesel and number 2 fuel oil are typically obtained from the light gas oil cut. The burning of number 2 fuel oil results in well-documented environmental pollution, including significant air pollution by $SO_X$ and $NO_X$ production and high carbon footprint.

Efforts to find alternative fuels to those derived from petroleum, such as gasoline and diesel fuel, have led to the development of biodiesel fuel. Traditional biodiesel is produced by transesterification of vegetable oils or fats. In such a process, a vegetable fat or oil reacts with an esterifying agent, typically an alcohol, for example methanol or ethanol, with or without a catalyst and with the input of additional energy usually at atmospheric pressure. The time of the reaction can range from 0.5 to 8 hours depending on the temperature.

A common vegetable-oil-derived fuel, typically used as a fuel for diesel engines is referred to as "biodiesel." Biodiesel is made utilizing the chemical reaction known as transesterification. The process forms two principal products, fatty acid methyl esters (FAME, the chemical name for biodiesel), and glycerin. In this reaction, a vegetable oil or fat reacts with an esterifying agent, usually an alcohol (e.g., methanol or ethanol), with or without a catalyst and with the input of additional energy, normally at atmospheric pressure. The reaction time can vary from about 0.5 to about 8 hours depending on the temperature and whether or not a catalyst is used. A biodiesel fuel generated in this way can be used used in its pure form (in other words without being "diluted" with another fuel, whether a petroleum based fuel or ethanol) or diluted with another fuel, e.g., diesel fuel or gas oil. In its pure form the biodiesel is referred to as B-100; in diluted forms, it is typically identified by the percentage of biodiesel present, e.g., B5, B20, B30, etc.

Burners using a mixture of water and biodiesel in the combustion chamber can produce lower NOx, hydrocarbon, and particulate emissions per unit of power output. The water but acts to lower peak combustion temperatures that result in less NOx formation. Water can be separately injected, but hardware costs are high. Water can also be added to the fuel as an emulsion. However, emulsion stability has historically been a problem.

Therefore, there remains a need for a renewable fuel that is stable, produces reduced emissions, and requires virtually zero infrastructure changes to the boiler.

SUMMARY OF THE INVENTION

Accordingly, an object of the present invention provides a stable fuel composition that can be used as a drop-in replacement for number 2 fuel oil without requiring infrastructure changes. The fuel comprises a continuous phase of mostly biofuel, an aqueous disperse phase, and at least one emulsifier. The continuous phase contains about 50 wt % to about 95 wt % (based on the total weight of the fuel composition) of at least one liquid vegetable or liquid animal oil/fat or mixtures thereof; and about 1 wt % to about 20 wt % of a renewable or fossil fuel derived thinning solvent or mixtures thereof. Henceforth, all wt % are weight percent based on the total weight of the fuel composition. The aqueous phase contains about 1 wt % to about 50 wt % of deionized/purified water. The continuous phase may, in certain embodiments, contains about 1 wt % to about 25 wt % of a C1-C4 monohydric alcohols, and/or about 1 wt % to about 30 wt % of petroleum middle distillate; however, anyone of those components may not be necessary. The aqueous phase may, in certain embodiments, contains about 1 wt % to about 25 wt % of a hydroxyl-containing organic compound selected from the group of C1-C4 monohydric alcohols, but the alcohol may not be necessary for the present invention. Preferably, the fuel composition of the present invention has the following characteristics:

Viscosity—<25 $mm^2$/sec
Flashpoint—100-150° F.
pH—5.5 to 7.5
Droplet size—<30 microns Another object of the present invention is to provide a method for making a stable fuel composition. The method requires making component A by mixing together the ingredients of the continuous phase (vegetable oil, liquid animal fat, and/or used cooking oil; thinning solvent; any alcohol and/or petroleum middle distillate) and lipophilic emulsifier using an agitator for a minimum of 20 minutes. Separately, the aqueous phase (component B) is made by mixing purified/deionized water with or without alcohol. Component B is then added to component A and agitated to achieve an average droplet size of less than about 30 microns, more preferably about 0.1 to 5 microns. In certain embodiments, a conditioner, e.g. ammonia (about of about 0.01 wt % to 2 wt %) may be added to either component A or B or after the components A and B are mixed. The composition is prepared from those components by mixing, preferably under high shear conditions to produce an average droplet size of less than about 30 microns.

The present fuel composition is preferably used as a drop-in replacement for number 2 fuel oil, particularly for use in stationary boiler applications used in heating and processing of local, state and federal government; hospitals; commercial, light industrial facilities; and power generation facilities. Many package boilers are installed in schools, barracks, apartment complexes, hospitals, and government buildings use number 2 fuel oil to generate the heat or steam in the winter. Yet, other facilities use the boilers to generate hot water or steam throughout the year. The present fuel composition provides an economically competitive alternative to number 2 fuel oil, is produced from renewable sources, and provides reduced emissions and pollutants to the environment.

DETAILED DESCRIPTION OF THE PREFERRED EMBODIMENTS

The fuels useful in the present invention are based on animal derived oils and fats as well as on vegetable oils and fats, including mixtures thereof. As used herein "oil" and "fat" are used interchangeably and have the same meaning. Vegetable oils and fats are substances that are present, in variable percentages, in the seeds or in the fruits of various plants. In addition to those that are typically available in nature, the present invention can also utilize vegetable oils and fats that are obtained from genetically engineered plants, including algae, and including those that may be developed to yield particularly high levels of oils and fats so that they are particularly preferred sources of such materials for use as fuels. Since the fats and oils are to be used in the compositions of the present invention and burned as fuel, it is not necessary that such fats and oils be edible. At the present time, the most common, commercially available vegetable oils are obtained from the seeds of peanuts, sunflowers, soy, sesame, colza (similar in its properties to rapeseed oil, but obtained from the seeds of *Brassica campestris*, var. *oleifera*), rape or canola, corn and cotton, and from the fruits of palm, olive, and coconut. The fatty substance can be obtained from treatment of the entire fruit (for example, olive oil), the pulp (palm oil), or just the kernel (palm seed oil). All of these vegetable based or derived oils are examples of vegetable oils suitable for use in the present invention. Other vegetable oils that may be useful in the present invention include crambe oil, jatropha oil, linseed oil, tung oil, as well as other so-called minor oil crops as described in "Minor Oil Crops," FAO Agricultural Services Bulletin No. 94, Food and Agricultural Organization of the United Nations, Rome, 1992, incorporated herein by reference. Such oils generally includes among the minor edible oil crops: argan; avocado; babassu palm; balanites; borneo tallow nut; brazil nut; *caryocar* spp; cashew nut; chinese vegetable tallow; cohune palm; the cucurbitaceae family including gourd, buffalo gourd, fluted pumpkin, and marrow; smooth loofah; grapeseed; illipe; kusum; macadamia nuts; mango seed; noog abyssinia; nutmeg; perilla; pili nut; rice bran; sacha inche; seje; shea nut; and teased. Among the minor non-edible oil crops are: allanblackia; almond; chaulmoogra; *cuphea* spp.; jatropa curgas; karanja seed; neem; papaya; tonka bean; tung; and ucuuba. Vegetable oils are obtained from their vegetable plants, seeds, etc. by methods well known in the art, including mechanical extraction or pressing as well as chemical or solvent extraction, and are typically filtered to remove extraneous matter in order to deliver a substantially clean product. However, it is within the scope of the present invention that used vegetable oil or fat from commercial sources can also be used, including, for example, food frying operations, i.e. used cooking oil.

Oils and fats useful in the present invention can also be obtained from animal sources. Such animal derived or extracted oils include, but are not limited to, animal tissue extract, piscine oil, cod-liver and shark-liver oil, fish oil in general, including oil from a wide variety of oil bearing fish some of which may be farmed for that purpose including fish oil currently being promoted by the Alaskan fish industry, tallow and mixtures thereof. For purposes herein, tallow refers to fat obtained from parts of the bodies of cattle, sheep, oxen, horses, chickens and other birds raised for food purposes, and the like as well as similar fats, such as those obtained from plants and also referred to as tallow. Large quantities of animal derived fats and oils can be obtained as byproducts from meat rendering facilities or used cooking oil. Mixtures of oils and fats obtained from vegetable and animal sources are also useful in the present invention.

The liquid vegetable and animal derived oils and fats can also be oils and fats obtained from recycled oil and grease usually from restaurants and food processing plants. Such fats and oils may originally be from vegetable or animal sources. It is to be understood that oils and fats from these sources can still be useful even though they may require some pretreatment in order to remove food and other particulate matter as well as to reduce acidity from free fatty acids or sulfur-containing compounds that may be present, using methods well known to those skilled in the art.

The liquid vegetable oil and/or animal oil is used at about 50 wt % to about 95 wt %, preferably about 60 wt % to about 75 wt %, more preferably about 63 wt % to about 71 wt %.

The thinning solvent is used by the present invention to reduce the viscosity of the fuel composition. It is desirable to have a fuel viscosity in the range of about 10 cst to about 40 cst, preferably about 13 cst to about 28 cst, more preferably about 15 cst to about 22 cst. The thinning solvent can be obtained from renewable sources or fossil fuel. The thinning solvents can be, but are not limited to, turpentine, mineral spirit, acetone, naptha, methyl ethyl ketone (MEK), dimethylformamide (DMF), ethyl lactate, and combinations thereof. Turpentine and ethyl lactate are the preferred thinning solvent used for the present invention. The thinning solvent is used at about 1 wt % to about 20 wt %, preferably about 10 wt % to about 20 wt %, more preferably about 15 wt % to about 20 wt %.

The dispersed aqueous phase of the present contains about 1 wt % to about 50 wt % water, preferably about 8 wt % to about 20 wt %, more preferably about 12 wt % to about 18 wt %. The water used in the compositions of the present invention can be from any source. The water employed in preparing the fuel compositions of the present invention can be deionized and/or purified. Preferably, the water has been substantially demineralized by methods well known to those skilled in the art of water treatment in order to remove dissolved mineral salts and has also been treated to remove other additives or chemicals, including chlorine and fluorine. Methods for deionization of water are known in the art. For example, water can be deionized by passing through an ion-exchange resin which exchange hydrogen ion and hydroxide ion for dissolved minerals. The process removes the dissolved minerals from the water. Other processes for deionization can be, but are not limited to, electroionization, reverse osmosis, carbon filtration, and electrodialysis. The water can also be purified by filtration, distillation, and/or reverse osmosis. The purification and/or ionization render water with a low content of dissolved minerals, for example, salts of calcium, sodium and magnesium, and include little, if any, chlorine and/or fluorine as well as being substantially free of undissolved particulate matter. The substantial absence of such materials is expected to lead to improvements in the condition of metal surfaces in engines and burners, particularly the inner surfaces of cylinders and nozzles.

The present invention also contains at least one emulsifier at about 0.05 wt % to about 10 wt %, preferably about 0.1 wt % to about 3 wt %, more preferably about 0.5 wt % to about 2 wt %. Useful emulsiers can be, but are not limited to, sortitol esters, fatty acid esters, and polyakoxylated alkylphenol. To the extent that a particular surfactant includes atoms, groups or compounds that may unnecessarily contribute to pollution, e.g., sulfur, its use can be limited to the amount necessary for producing and/or maintaining a stable emulsion or fuel composition. Particularly preferred surfactants include cetyl alcohol, hydrogenated castor oil and mixtures of cetyl alcohol and hydrogenated castor oil. The following materials, referred to as surfactants herein, can be employed in accordance with the water-fuel composition of the present invention. In addition to cocamide diethanolamine and diethanolamine, the emulsifiers listed in Table 1 may be useful for the present invention:

TABLE 1

| Product Name* | Synonym | HLB |
|---|---|---|
| | 2,4,7,9-Tetramethyl-5-decyne-4,7-diol | 4.0 |
| | PEG-block-PPG-block-PEG, Mn = 1100 | 4.0 |
| | PEG-block-PPG-block-PEG, Mn = 2000 | 4.0 |
| | PEG-block-PPG-block-PEG, Mn = 2800 | 4.0 |
| | PEG-block-PPG-block-PEG, Mn = 4400 | 4.0 |
| | Ethylenediamine tetrakis(PO-b-EO) tetrol, Mn = 3600 | 4.0 |
| | Ethylenediamine tetrakis(EO-b-PO) tetrol, Mn = 7200 | 4.0 |
| | Ethylenediamine tetrakis(EO-b-PO) tetrol, Mn = 8000 | 4.0 |
| Igepal CA-210 | Polyoxyethylene(2) isooctylphenyl ether | 4.3 |
| Span 80 | Sorbitan monooleate | 4.3 |
| | PPG-block-PEG-block-PPG, Mn = 3300 | 4.5 |
| Igepal CO-210 | Polyoxyethylene(2) nonylphenyl ether | 4.6 |
| Span 60 | Sorbitan monostearate | 4.7 |
| Brij 92 | Polyoxyethylene(2) oleyl ether | 4.9 |
| Brij 72 | Polyoxyethylene(2) stearyl ether | 4.9 |
| Brij 52 | Polyoxyethylene(2) cetyl ether | 5.3 |
| Span 40 | Sorbitan monopalmitate | 6.7 |
| Merpol A surfactant | Nonionic, ethylene oxide condensate | 6.7 |
| | 2,4,7,9-Tetramethyl-5-decyne-4,7-diol ethoxylate | 8.0 |
| Triton SP-135 | | 8.0 |
| Span 20 | Sorbitan monolaurate | 8.6 |
| | PEG-block-PPG-block-PEG, Mn = 5800 | 9.5 |
| | PPG-block-PEG-block-PPG, Mn = 2700 | 9.5 |
| Brij 30 | Polyoxyethylene(4) lauryl ether | 9.7 |
| Igepal CA-520 | Polyoxyethylene(5) isooctylphenyl ether | 10.0 |
| Igepal CO-520 | Polyoxyethylene(5) nonylphenyl ether | 10.0 |
| | Polyoxyethylene sorbitol hexaoleate | 10.2 |
| Merpol SE surfactant | | 10.5 |
| Tween 85 | Polyoxyethylene(20) sorbitan trioleate | 11.0 |
| | 8-Methyl-1-nonanol propoxylate-block-ethoxylate | 11.0 |
| | 8-Methyl-1-nonanol propoxylate-block-ethoxylate | 11.0 |
| | Polyoxyethylene sorbitan tetraoleate | 11.4 |
| Triton X-114 | Polyoxyethylene(8) isooctylphenyl ether | 12.4 |
| Brij 76 | Polyoxyethylene(10) stearyl ether | 12.4 |
| Brij 97 | Polyoxyethylene(10) oleyl ether | 12.4 |
| Merpol OJ surfactant | | 12.5 |
| Brij 56 | Polyoxyethylene(10) cetyl ether | 12.9 |
| Merpol SH surfactant | | 12.9 |
| | 2,4,7,9-Tetramethyl-5-decyne-4,7-diol ethoxylate (5 EO/OH) | 13.0 |
| Triton SP-190 | | 13.0 |
| Igepal CO-630 | Polyoxyethylene(9) nonylphenyl ether | 13.0 |
| Triton N-101 | Polyoxyethylene branched nonylphenyl ether | 13.4 |
| Triton X-100 | Polyoxyethylene(10) isooctylphenyl ether | 13.5 |
| Igepal CO-720 | Polyoxyethylene(12) nonylphenyl ether | 14.2 |
| | Polyoxyethylene(12) tridecyl ether | 14.5 |
| | Polyoxyethylene(18) tridecyl ether | 14.5 |
| Igepal CA-720 | Polyoxyethylene(12) isooctylphenyl ether | 14.6 |
| Tween 80 | Polyoxyethylene(20) sorbitan monooleate | 14.9 |
| Tween 60 | Polyoxyethylene(20) sorbitan monostearate | 15.0 |
| | PEG-block-PPG-block-PEG, Mn = 2900 | 15.0 |
| | PPG-block-PEG-block-PPG, Mn = 2000 | 15.0 |

TABLE 1-continued

| Product Name* | Synonym | HLB |
|---|---|---|
| Brij 78 | Polyoxyethylene(20) stearyl ether | 15.3 |
| Brij 98 | Polyoxyethylene(20) oleyl ether | 15.3 |
| Merpol HCS surfactant | | 15.5 |
| Tween 40 | Polyoxyethylene(20) sorbitan monopalmitate | 15.6 |
| Brij 58 | Polyoxyethylene(20) cetyl ether | 15.7 |
| | Polyoxyethylene(20) hexadecyl ether | 15.7 |
| | Polyethylene-block-poly(ethytene glycol), Mn = 2250 | 16.0 |
| Tween 20 | Polyoxyethylene (20) sorbitan monolaurate | 16.7 |
| Brij 35 | Polyoxyethylene(23) lauryl ether | 16.9 |
| | 2,4,7,9-Tetramethyl-5-dicyne-4,7-diol ethoxylate (15 EO/OH) | 17.0 |
| Igepal CO-890 | Polyoxyethylene(40) nonylphenyl ether | 17.8 |
| Triton X-405 | Polyoxyethylene(40) isooctylphenyl ether | 17.9 |
| Brij 700 | Polyoxyethylene(100) stearyl ether | 18.8 |
| Igepal CO-990 | Polyoxyethylene(100) nonylphenyl ether | 19.0 |
| Igepal DM-970 | Polyoxyethylene(150) dinonylphenyl ether | 19.0 |
| | PEG-block-PPG-block-PEG, Mn = 1900 | 20.3 |
| | PEG-block-PPG-block-PEG, Mn = 8400 | 24.0 |
| | Ethylenediamine tetrakis(PO-b-EO) tetrol, Mn = 15000 | 24.0 |
| | PEG-block-PPG-block-PEG, average Mn = ca. 14,600 | 27.0 |

*Abbreviations: Mn = number average molecular weight: PEG = polyethylene glycol; PPG = polypropylene glycol; EO = ethylene oxide; PO = propylene oxide; HLB = hydrophilic-lipophilic balance.

Preferred emulsifiers for the present composition include compounds exhibiting a hydrophilic-lipophilic balance (HLB) in the range of less than about 7, preferably about 0.01 wt % to about 5 wt % , most preferably about 0.3 wt % to about 2 wt %. HLB is a well-known parameter utilized by those skilled in the art for characterizing emulsifiers. In certain embodiments, it may be advantageous to use a combination of emulsifiers. For purposes of explanation and not limitation, for example instead of a single emulsifier having an HLB value of about 1 to about 7, an emulsified fuel composition can be prepared using a mixture of emulsifiers, such as a mixture two emulsifiers, one having an HLB value of about 1 to about 6 and the other an HLB value of 6 to about 20. Similarly combinations of three or more emulsifiers can also be used, provided that the HLB value of the mixture exhibits the desired overall value and the effect of the mixture is to provide a stable emulsion. For purposes of a mixed emulsifier composition, as well-known in the art, the HLB value of the emulsifier mixture is calculated as a linear sum weighted average based on the weight fraction that each of the emulsifiers represents compared to the total amount of emulsifier present.

In certain embodiments, a mixture of two emulsifiers is used wherein one emulsifier has an HLB value of about 1 to about 6.0, or about 2 to about 5.9, or about 3 to about 5.5, or about 4 to about 5.9, and the like; and the second emulsifier has an HLB value of about 6 to about 20, or about 6.1 to about 18, or about 6.5 to about 16, or about 7 to about 15, and the like; provided that both emulsifiers do not have an HLB value of 6 (i.e. the same HLB) and that the HLB of the mixture is about 1 to about 7. Alternatively, one emulsifier comprising a bimodal distribution of chemical species exhibiting each of the HLB properties can be used.

Although some embodiments of the present invention exclude alcohol, certain other embodiments may contain alcohol. The alcohols useful in the present invention include hydroxyl-containing organic compounds selected from the group consisting of C1-C4 monohydric (one OH group) alcohols characterized as (1) aliphatic, including straight and branched chain, and sub-characterized within this group as paraffinic (for example, ethanol) and olefinic (for example, allyl alcohol); (2) alicyclic (for example, cyclohexanol); (3) aromatic (for example, phenol, benzyl alcohol); (4) heterocyclic (for example, furfuryl alcohol); and (5) polycyclic (for example, sterols). The fuel compositions, when the C1-C4 monohydric alcohol is used, preferably do not also include a tert-butyl alcohol or a C2-C4 alkylene glycol. Ethanol and N-butanol are particularly preferred in the compositions of the present invention. Ethanol is available commercially in the anhydrous form (also referred to as absolute alcohol or 100% ethanol) and as various proofs or percentages of ethanol where the additional component in the ethanol is water, the most common being 190 proof or 95 vol %. If ethanol is used for purposes other than as a beverage, it is denatured by addition of substances, such as methanol, 2-propanol, ethyl acetate, methyl isobutyl ketone, heptane or kerosene, to make the product undesirable for human consumption, but allows for its use for industrial purposes, including as a component in fuel or as a fuel. Certain denaturants may not be suitable for use in connection with fuels because of their adverse effects on fuel stability, burner system, and emissions. Denaturants that may be unsuitable for use in connection with fuels are known to those skilled in the art and are often specified by various governmental agencies. The standards in ASTM D4806 and ASTM D5798, incorporated herein by reference, describe the amount and types of denaturants typically permitted for use in fuels and also identifies others that should not be used in view of their potentially adverse effects, as noted above. Furthermore, ASTM D5798 also describes the standards for fuels for use in engines that are designed to utilize ethanol as a substitute for petroleum, i.e., that include substantially high percentages of ethanol. The alcohol can be added either to the continuous phase and/or the disperse phase. In the continuous phase or the disperse phase, the alcohol can be used at about 1 wt % to about 25 wt %, preferably about 1 wt % to about 12 wt %, more preferably about 4 wt % to about 8 wt %.

Although some embodiments of the present invention exclude petroleum middle distillate, in certain other embodiments, the continuous phase may contain a petroleum middle distillate, preferably at about 1 wt % to 30 wt %, more preferably about 2 wt % to about 25 wt %, most preferably about 5 wt % to about 22 wt %. The petroleum middle distillate is a fraction of crude oil distillation having boiling points between 160° C. and 420° C., and contains mostly gas oil, diesel and/or kerosene. Ultra low sulfur diesel is the preferred petroleum middle distillate for the present invention.

Optionally, additives may be added to the emulsifier, the vegetable oil, the water or combinations thereof. The additives include, but are not limited to, conditioners, cetane improvers, and bases to increase the pH of the fuel composition. The additives are added to the emulsifier, the vegetable/animal oil, or the water prior to and in the alternative at the emulsification device(s) depending upon the solubility or other fluid properties of the additive. The additives are generally in the range of about 0.01 wt % to about 5 wt % of the composition, preferably about 0.05 wt % to about 2 wt %, and more preferably about 0.05 wt % to about 1 wt %.

Cetane improvers are added to the fuel composition to adjust the cetane number of the fuel. Cetane improvers are used to adjust the cetane number of the fuel composition and can be used at about 0.01 wt % to about 5 wt %, preferably about 0.01 wt % to about 2 wt %, more preferably about 0.01 wt % to about 1 wt %. Useful cetane improvers can be, but are not limited to, peroxides, nitrates, nitrites, nitrocarbamates, mixtures thereof and the like. Useful cetane improvers include but are not limited to nitropropane, dinitropropane, tetranitromethane, 2-nitro-2-methyl-1-butanol, 2-methyl-2-nitro-1-propanol, and the like. Also included are nitrate esters of substituted or unsubstituted aliphatic or cycloaliphatic alcohols which may be monohydric or polyhydric. These compounds include substituted and unsubstituted alkyl or cycloalkyl nitrates having up to about 10 carbon atoms, and in one embodiment about 2 to about 10 carbon atoms. The alkyl group may be either linear or branched, or a mixture of linear or branched alkyl groups. Examples of such compounds include methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also useful are the nitrate esters of alkoxy-substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate. A useful cetane improver is 2-ethylhexyl nitrate.

Organic peroxides can also be useful as cetane improvers in the fuel compositions herein. Generally useful compounds are dialkyl peroxides of the formula R1OOR2 wherein R1 and R2 are the same or different alkyl groups having 1 to about 10 carbon atoms. Suitable peroxide cetane improver compounds should be soluble in the fuel composition and thermally stable at typical fuel temperatures of operating engines. Peroxides wherein R1 and R2 are tertiary alkyl groups having about 4 or about 5 carbon atoms are especially useful. Examples of suitable peroxides include di-tertiary butyl peroxide, di-tertiary amyl peroxide, diethyl peroxide, di-n-propyl peroxide, di-n-butyl peroxide, methyl ethyl peroxide, methyl-t-butyl peroxide, ethyl-t-butyl peroxide, propyl-t-amyl peroxide, mixtures thereof and the like. Preferred peroxides generally exhibit one or more and preferably most of the following characteristics: good solubility in the fuel, suitable water partition coefficient characteristics, good thermal stability and handling characteristics, have no impact on fuel quality or fuel system components, and have low toxicity. A useful peroxide is di-tertiary butyl peroxide, also sometimes referred to as tertiary butyl peroxide.

Bases can be used to adjust the pH of the fuel composition to a range of about 5 to about 7.5, preferably about 5.5 to about 7.2, more preferably about 5.5 to about 6.8. The base material may be organic or inorganic bases, such as alkoxides, hydroxides, carbonates, trialkyl amines, etc. The alkoxides can be, but are not limited to, sodium methoxide, sodium ethoxide, sodium/potassium tert-butoxide, etc. The hydroxides can be, but are not limited to, sodium hydroxide, potassium hydroxide, ammonium hydroxide, etc. The metal carbonates can be sodium carbonates, potassium carbonates, etc. The trialkyl amine base can be, but are not limited to, triethyl amine, disiopropylethyl amine, etc. The preferred base is ammonium hydroxide or ammonia.

The components of the present fuel composition are mixed in a particular order to ensure stability of the composition. It is critical that the components of the continuous phase and of the dispersed phase are mixed separately first. The two mixtures are then added together to form the composition. The emulsifier(s) can be added either to the continuous phase, the disperse phase, or when the two mixtures are added together, but it is preferably added to the continuous phase. The other optional components can be added at the end when the two mixtures are combined. Prior to any mixing, it is preferred that the vegetable/animal oils are heated preferably to about 20° C. to about 82° C., more preferably to about 35° C. to about 80° C., most preferably to about 75° C. The heated mixture is then filtered to remove any particulate matters in the oils. The filtration is preferably accomplished by passing the heated oil through a filter having pore size of about 5 micron to about 120 micron, more preferably about 10 micron to about 100 micron, most preferably about 25 micron to about 50 micron.

Once the mixtures are added together the composition is agitated to form a water-droplet in oil suspension. Preferably, the agitation is sufficient to produce an average droplet size in the range of less than about 30 microns, more preferably about 0.1 microns to about 20 microns, most preferably about 0.1 microns to about 5 microns. The agitation can accomplished using methods and devices well-known in the art including, for example, mixer-emulsifiers, which typically utilize a high speed rotor operating in close proximity to a stator (such as a type made by Charles Ross & Sons Co., NY), paddle mixers utilizing paddles having various design configurations including, for example, reverse pitch, anchor, leaf, gate, finger, double-motion, helix, etc., including batch and in-line equipment, and the like. The processes of various embodiments of the present invention can be carried out at a convenient temperature, including, for example, at ambient or room temperature, such as about 20° C. to about 22° C. or even as high as 25° C. The time and temperature of mixing can be varied provided that the desired emulsified composition is achieved and, based on subsequent observation and/or testing, it is suitably stable until it is used, as well as during use. The agitation time period should be sufficient to achieve the desired droplet size. The agitation time can readily be determined with limited and simple experiments and such time can be adjusted, based on, for example, the type, quality and composition of the vegetable oil employed, as well as the other components of the mixture, including emulsifier(s). Preferably, high shear devices, such as ultrasonic mixers, are used for agitation to produce the smaller average droplet sizes.

Without further description, it is believed that one of ordinary skill in the art can, using the preceding description and the following illustrative examples, make and utilize the compounds of the present invention and practice the claimed methods. The following example is given to illustrate the present invention. It should be understood that the invention is not to be limited to the specific conditions or details described in this example.

EXAMPLES

Compositions of the present invention and their mixing steps are presented in Tables 2-4.

TABLE 2

Ingredients/Formula
Batch Size: 72 oz
Process: Water-in-Oil Emulsion

| Ingredients | Specification/ Description | MFG Part Number/ Type | QTY % Batch | Batch QTY by Volume (ounces) |
|---|---|---|---|---|
| Corn Oil (non-edible) | 8001-30-7 | BE Tank #34 <30 μS/cm | 65.00% | 46.8 |
| Deionized/ Purified Water | 7732-18-5 | conductivity | 15.00% | 10.8 |
| Turpentine | 8006-64-2 | Gum Spirits | 12.00% | 8.64 |
| Alcohol (Ethanol) | 64-17-5 | Ethanol | 7.00% | 5.04 |
| Hypermer 1083SF (a primary emulsifier and Polymeric ester (A-B-A type)) | Primary Surfactant-HLB 5.0 | Croda | 1.00% | 0.72 |
| | | | | 0 |
| | | | | 0 |
| | Total Batch | | 100.00% | 72 |

Mixing Procedure

| Step | Description | Equipment | Mix Time | Res Time |
|---|---|---|---|---|
| 1 | Add oil and turpentine to ninja mix container. Mix | Ninja | 5 min | |
| 2 | Add DI/AL/& Hypermer to 20 oz stick cup. Stick mix | Stick blender- | 1 min | |
| 3 | Add DI solution to Oil in ninja. Mix | Ninja | 5 min | |

TABLE 3

Ingredients/Formula
Batch Size: 72 oz
Process: Water-in-Oil Emulsion

| Ingredients | Specification/ Description | MFG Part Number/ Type | QTY % Batch | Batch QTY by Volume (ounces) |
|---|---|---|---|---|
| Corn Oil (non-edible) | 8001-30-7 | BE Tank #34 <30 μS/cm | 69.00% | 49.68 |
| Deionized/ Purified Water | 7732-18-5 | conductivity | 15.00% | 10.8 |
| Turpentine | 8006-64-2 | Gum Spirits | 11.00% | 7.92 |
| Alcohol | 71-36-3 | N Butyl | 4.00% | 2.88 |
| Hypermer 1083SF | Primary Surfactant-HLB 5.0 | Croda | 0.90% | 0.648 |
| Ammonia Hydroxide Be 26 | 1336-21-6 PH enhancer | | 0.10% | 0.072 |
| | | | | 0 |
| | | | | 0 |
| | Total Batch | | 100.00% | 72 |

Mixing Procedure

| Step | Description | Equipment | Mix Time | Res Time |
|---|---|---|---|---|
| 1 | Add oil, turpentine & hypermer to ninja mix container. Mix | Ninja | 5 min | |
| 2 | Add DI & AL to 20 oz stick cup. Stick mix | Stick blender- | 1 min | |
| 3 | Add DI solution to Oil in ninja. Mix | Ninja | 5 min | |
| 4 | Add 3 drops of Ammonia to oil in ninja. Mix | Ninja | 1 min | |
| 5 | Add ⅛ tsp of Ammonia to oil in ninja. Mix | Ninja | 1 min | |

TABLE 3-continued

| | | | |
|---|---|---|---|
| 6 | Add 3 drops of Ammonia to oil in ninja. Mix | Ninja | 1 min |

TABLE 4

Ingredients/Formula
Batch Size: 72 oz
Process: Water-in-Oil Emulsion

| Ingredients | Specification/ Description | MFG Part Number/Type | QTY % Batch | Batch QTY by Volume (ounces) |
|---|---|---|---|---|
| Corn Oil (non-edible) | 8001-30-7 | BE-Lima OH sample | 72.00% | 51.84 |
| Deionized/ Purified Water | 7732-18-5 | <30 μS/cm conductivity | 11.80% | 8.496 |
| Turpentine | | Gum Spirits | 8.00% | 5.76 |
| Kerosene | | K1 | 7.00% | 5.04 |
| Hypermer | Primary | Croda | 1.00% | 0.72 |
| 1083SF | Surfactant-HLB 5.0 | | 0.00% | 0 |
| Ammonium Hydroxide | | | 0.20% | 0.144 0 |
| | Total Batch | | 100.00% | 72 |

Mixing Procedure

| Step | Description | Equipment | Mix Time | Res Time |
|---|---|---|---|---|
| 1 | Add oil, turpentine, kerosene & hypermer to ninja mix container. Mix | Ninja | 10 min | |
| 2 | Add DI into 20 oz stick cup. Stick mix | Stick blender- | 1 min | |
| 3 | Add DI solution to Oil in ninja. Mix | Ninja | 10 min | |
| 4 | Add 5 drops of Ammonia to oil in ninja. Mix | Ninja | 1 min | |
| 5 | Add ⅛ tsp of Ammonia to oil in ninja. Mix | Ninja | 1 min | |
| 6 | Add ⅛ tsp of Ammonia to oil in ninja. Mix | Ninja | 1 min | |

While particular embodiments have been chosen to illustrate the invention, it will be understood by those skilled in the art that various changes and modifications can be made therein without departing from the scope of the invention as defined in the appended claims.

What is claimed is:

1. A biofuel composition comprising an aqueous emulsion having:

(a) a continuous phase comprising (i) about 50 wt % to about 95 wt % of at least one liquid vegetable oil or liquid animal fat or mixtures thereof, (ii) about 1 wt % to about 20 wt % of a renewable or fossil fuel derived thinning solvent or mixtures thereof; and (iii) about 1 wt % to about 25 wt % of a of a hydroxyl-containing organic compound selected from the group consisting of $C_1$-$C_4$ monohydric alcohols;

(b) an aqueous dispersed phase comprising about 1 wt % to about 50 wt % of deionized/purified water and wherein component (b) further comprises about 1 wt. % to about 25 wt. % of a hydroxyl-containing organic compound selected from the group of $C_1$-$C_4$ monohydric alcohols; and (c) about 0.05 wt % to about 10 wt % of at least one emulsifier;

wherein the composition does not include tert-butyl alcohol or a $C_2$-$C_4$ alkylene glycol.

2. The biofuel composition of claim 1, wherein component (a) further comprises about 1 wt % to about 30 wt % of petroleum middle distillate.

3. The biofuel of claim 1, wherein the emulsifier exhibits a hydrophilic-lipophilic balance (HLB) of about 1 to about 7.

4. The biofuel of claim 1, wherein the emulsifier comprises a mixture of at least two emulsifiers wherein at least one of the two emulsifiers exhibits a HLB value of about 1 to about 6 and at least one of the two emulsifiers exhibits a HLB value of about 6 to about 20, provided that the mixture of the at least two emulsifiers exhibits an HLB value of less than about 7.

5. The biofuel of claim 1, wherein the at least one emulsifier is selected from the group consisting of polymeric ester (A-B-A Type), sorbitan ester (monooleate), sorbitan trioleate, polyoxyethylene (20) sorbitan monooleate, diethanolamine, and mixtures thereof.

6. The biofuel of claim 1, wherein the emulsifier is a combination of cocamide diethanolamine and diethanolamine.

7. The biofuel of claim 1, wherein the source of the liquid vegetable oil or liquid animal fat is used cooking oil.

8. The biofuel of claim 1, further comprising an effective amount of an additive to increase the cetane number of the biofuel composition.

9. The biofuel of claim 1, further comprising an effective amount of an additive to increase the pH of the biofuel composition.

10. The biofuel of claim 1, further comprising about 0.1% to about 20% of ethyl lactate.

11. A method of preparing the biofuel composition of claim 1 comprising:

mixing the continuous phase component, the aqueous phase component, and the emulsifier to produce a dispersion of water-containing droplets having an average particle size of less than about 30 microns.

12. The method of claim 11, wherein the continuous phase component further contains about 1 wt % to about 30 wt % of petroleum middle distillate.

13. The method of claim 11, wherein the aqueous component further contains about 1 wt % to about 25 wt % of a hydroxyl-containing organic compound selected from the group of $C_1$-$C_4$ monohydric alcohols.

14. The method of claim 11, wherein the emulsifier exhibits a hydrophilic-lipophilic balance, HLB, of about 1 to about 7.

15. The method of claim 11, wherein the at least one emulsifier is selected from the group consisting of polymeric ester (A-B-A Type), sorbitan ester (monooleate), sorbitan trioleate, polyoxyethylene (20) sorbitan monooleate, diethanolamine, and mixtures thereof.

16. The method of claim 11, wherein the emulsifier is a combination of cocamide diethanolamine and diethanolamine.

17. The method of claim 11, wherein the continuous phase component, the aqueous phase component, and the emulsifier are provided and mixed substantially simultaneously.

18. The method of claim 11, wherein the mixing is accomplished using high shear generating mixing equipment.

19. The method of claim 11, wherein the average particle size is about 0.1 to about 5 microns.

20. The method of claim 11, further comprising adding an effective amount of an additive to increase the cetane number of the biofuel composition.

21. The method of claim 11, further comprising adding an additive to increase the pH of the biofuel composition to a range of about 5 to about 7.5.

22. The method of claim 11, further comprising adding about 0.1% to about 20% of ethyl lactate to reduce the viscosity of the biofuel composition.

23. The method of claim 11, wherein the emulsifier comprises a mixture of at least two emulsifiers wherein at least one of the two emulsifiers exhibits a low HLB value of about 1 to about 6 and at least one of the two emulsifiers exhibits a high HLB value of about 6 to about 20, provided that the mixture exhibits an HLB value of less than about 7.

24. The method of claim 11, wherein the liquid vegetable oil or animal fat in the continuous phase component is heated to 80° F. and filtered through a 30 micron filter prior to the mixing step.

25. An emulsified fuel mixture prepared from the following components: (A) 650 parts vegetable or animal oil or fat; and (B) 150 parts water; and (C) 120 parts of an organic solvent (D) 70 parts denatured ethanol 90 wt % (E) 10 parts of a surfactant with a hydrophilic-lipophilic balance of about 5.0; wherein the composition does not include tert-butyl alcohol or a $C_2$-$C_4$ alkylene glycol.

26. An emulsified fuel mixture prepared from the following components: (A) 690 parts vegetable or animal oil or fat; and (B) 150 parts water; and (C) 110 parts of an organic solvent (D) 40 parts of n-butyl alcohol and (E) 9 parts of a surfactant with a hydrophilic-lipophilic balance of about 5.0 and (F) 1 part of ammonium hydroxide 26 Baumé;
wherein the composition does not include tert-butyl alcohol or a $C_2$-$C_4$ alkylene glycol.

* * * * *